US007431008B2

(12) United States Patent
Lindner et al.

(10) Patent No.: US 7,431,008 B2
(45) Date of Patent: Oct. 7, 2008

(54) IGNITION SYSTEM OF AN INTERNAL COMBUSTION ENGINE

(75) Inventors: Friederike Lindner, Gerlingen (DE); Ulrich Eisele, Stuttgart (DE); Jasim Ahmed, Menlo Park, CA (US); Aleksandar Kojic, Sunnyvale, CA (US); Jean-Pierre Hathout, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/393,564

(22) Filed: Mar. 29, 2006

(65) Prior Publication Data

US 2006/0225692 A1 Oct. 12, 2006

(30) Foreign Application Priority Data

Apr. 8, 2005 (DE) ..... 10 2005 016 125

(51) Int. Cl.
*F02M 57/06* (2006.01)
*F02B 51/00* (2006.01)
*F02P 23/00* (2006.01)

(52) U.S. Cl. ..... 123/280; 123/536; 123/297; 123/143 B

(58) Field of Classification Search ..... 123/1 A, 123/2–3, 268, 274, 280, 284, 297, 536–539, 123/143 B
See application file for complete search history.

(56) References Cited

U.S. PATENT DOCUMENTS

| | | | | |
|---|---|---|---|---|
| 3,092,088 | A | 6/1963 | Goossak et al. | |
| 3,230,939 | A | 1/1966 | Goossak | |
| 4,043,308 | A * | 8/1977 | Cerkanowicz | 123/143 R |
| 4,250,852 | A | 2/1981 | Kerimov et al. | |
| 4,361,122 | A | 11/1982 | Latsch | |
| 4,416,228 | A | 11/1983 | Benedikt et al. | |
| 4,582,475 | A * | 4/1986 | Hoppie | 431/6 |
| 4,672,938 | A * | 6/1987 | Hoppie et al. | 123/538 |
| 4,924,828 | A | 5/1990 | Oppenheim | |
| 5,063,122 | A * | 11/1991 | Rohr | 429/32 |
| 5,256,036 | A * | 10/1993 | Cole | 417/48 |
| 5,378,345 | A * | 1/1995 | Taylor et al. | 204/421 |
| 5,522,357 | A | 6/1996 | Nogi et al. | |
| 5,829,419 | A * | 11/1998 | Sadkin et al. | 123/538 |
| 6,250,072 | B1 * | 6/2001 | Jacobson et al. | 60/251 |
| 6,439,207 | B1 * | 8/2002 | Liu | 123/536 |
| 6,453,889 | B1 * | 9/2002 | Hansen et al. | 123/536 |
| 6,474,315 | B1 * | 11/2002 | Sadkin et al. | 123/538 |
| 6,725,824 | B2 * | 4/2004 | Donauer et al. | 123/255 |
| 6,732,720 | B2 * | 5/2004 | Kelemencky | 123/536 |
| 6,821,663 | B2 * | 11/2004 | McElroy et al. | 429/17 |
| 2005/0153186 | A1 * | 7/2005 | Hilmi et al. | 429/30 |

FOREIGN PATENT DOCUMENTS

JP 2006-242043 * 9/2006

* cited by examiner

*Primary Examiner*—Hai H Huynh
(74) *Attorney, Agent, or Firm*—Kenyon & Kenyon LLP

(57) ABSTRACT

An ignition system of an internal combustion engine, of a motor vehicle in particular, having at least one device for igniting a jet of a fuel/air mixture which has a chamber enclosing a process space in which the ignition of the fuel/air mixture takes place. The chamber has a device for enriching the process space with oxygen radicals.

13 Claims, 4 Drawing Sheets

IGNITION SYSTEM OF AN INTERNAL COMBUSTION ENGINE

FIELD OF THE INVENTION

The present invention relates to an ignition system of an internal combustion engine having a device for igniting a jet of a fuel/air mixture.

BACKGROUND INFORMATION

Early designs of ignition systems including jet ignition sources for motor vehicles having internal combustion engines are described in U.S. Pat. Nos. 3,092,088; 3,230,939; and 4,250,852, for example. Refinements of such an ignition system having a precombustion chamber and often two or more jet ignition sources are described in U.S. Pat. Nos. 4,361,122; 4,416,228; 4,924,828, and 5,522,357, for example.

The feature common to all these ignition systems having what is referred to as jet ignition (JI) is that a spark is required for initializing the combustion of fuel in a combustion chamber of the internal combustion engine; a spark plug must be provided for spark generation.

The quality of the combustion process is basically limited when a spark is used as the combustion triggering pulse since high temperatures prevail here by the nature of the system and the ignition point is difficult to influence.

The concept of what is known as compression ignition represents an alternative which is, however, usually very complex with regard to its design layout.

Therefore, it is an object of the present invention to provide an ignition system of an internal combustion engine having a device for igniting a jet of a fuel/air mixture using which improved quality of the combustion process is achievable in contrast to ignition systems having a conventional spark ignition, and which is implementable involving little technical complexity.

SUMMARY OF THE INVENTION

In a design according to the present invention, in which the chamber has a device for enriching the process space with oxygen radicals, an ignition system of an internal combustion engine, of a motor vehicle in particular, having a device for igniting a jet of a fuel/air mixture having at least one chamber, which includes a process space in which the ignition of the fuel/air mixture takes place, has the advantage that no spark for the ignition and no spark plug, necessary for generating the spark, are required.

Due to the presence of oxygen radicals, self-ignition of a fuel/air mixture, e.g., in a precombustion chamber of an internal combustion engine of a motor vehicle, is possible in which substantially lower temperatures may prevail than is the case with temperatures occurring in a spark ignition using a spark plug. The quality of the combustion process may be improved overall due to the lower temperatures.

Furthermore, the fact that the ignition point may be better influenced in an ignition according to the present invention contributes to the improvement on the combustion since the ignition delay time of a fuel/air mixture may be substantially and selectively reduced using oxygen radicals.

The ignition system according to the present invention allows for reliable ignition of the fuel/air mixture having any volumetric efficiency, so that the ignition system according to the present invention is suitable for very lean fuel/air mixtures having a volumetric efficiency of, for example, $\lambda=2$ as well as stoichiometric mixtures having a volumetric efficiency of $\lambda=1$ or rich mixtures having a volumetric efficiency of $\lambda<1$.

Furthermore, an ignition system according to the present invention is characterized in that the chamber having the process space for the ignition may have very small dimensions; therefore, one or more precombustion chamber(s) for igniting an internal combustion engine may be designed according to the present invention to have a very small volume compared to a main chamber, e.g., having a volume of 1 $cm^3$ or less. The required small installation space is also a consequence of the fact that a spark plug, such as in a spark ignition, or complex moving parts, such as in a compression ignition, may be dispensed with.

The ignition system according to the present invention may easily be integrated into existing designs of internal combustion engines, is rugged, and has low maintenance due to the simple design layout.

In a particularly simple design of an ignition system according to the present invention, the device for enriching the process space with oxygen radicals may include at least one oxygen ion conductor which may be made of a ceramic material, forming a solid electrolyte, and may form a layer of a chamber wall.

DETAILED DESCRIPTION

Figure 1:
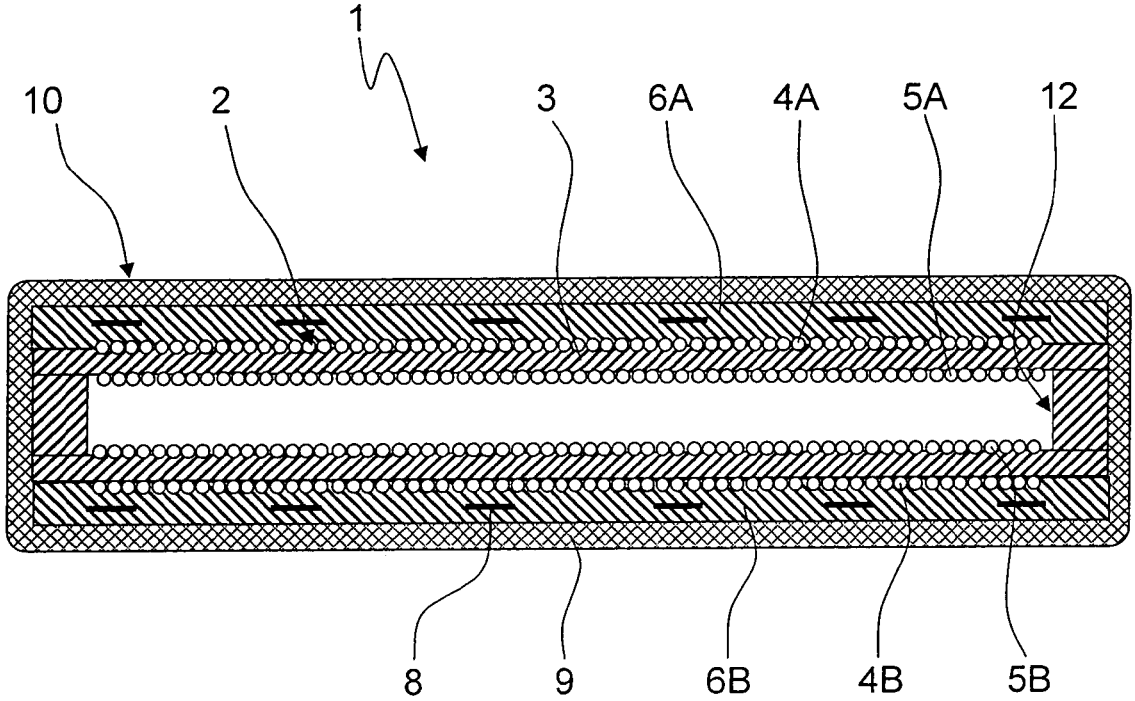
FIG. 1 shows a schematic diagram of a device for igniting a jet of a fuel/air mixture having a chamber including a process space.

With reference to FIG. 1, a device 1 for igniting a jet of a fuel/air mixture for combustion in an internal combustion engine of a motor vehicle is shown which has a chamber 10 which encloses a process space 11 having a wall 12.

Device 1 is designed for igniting the fuel/air mixture with the aid of oxygen radicals and has, for this purpose, a device 2 for adding oxygen radicals to process space 11 of chamber 10. Device 2 includes an oxygen ion conductor 3 which in the present case is formed frame-like on wall 12 of chamber 10 and represents an innermost layer of wall 12 of chamber 10 having a multilayer design.

Oxygen ion conductor 3 is in the present case made from yttrium (Y)-doped zirconium dioxide ($ZrO_2$). Controlled doping of ceramics such as zirconium dioxide makes it possible to create oxygen ion vacancies and to transform the ceramic, doped in this way, into a very good electrical oxygen ion conductor which in turn forms a solid electrolyte.

In the exemplary embodiment shown, oxygen ion conductor 3 is situated on opposite walls of chamber 10, between a cathode forming electrode 4A and 4B on its side facing away from process space 11 and an electrode 5A and 5B acting as an anode on its side facing process space 11.

An oxygen pump is formed by $ZrO_2$ oxygen ion conductor 3 and electrodes 4A, 5A, and 4B, 5B which are preferably designed as platinum electrodes, oxygen radicals being released from anode 5A and 5B facing process space 11.

A ceramic layer 6A and 6B, which in the present case is made of a porous material such as aluminum dioxide ($Al_2O_3$), is situated on the side of oxygen ion conductor 3 and possibly of cathode 4A, 4B facing away from process space 11 in the areas of their placement.

Ceramic layers 6A and 6B are in turn enveloped by a ceramic layer which in the present case is made of zirconium dioxide ($ZrO_2$) and which forms an outer layer 9 of chamber 10. This outer layer 9 made of porous ceramic and surrounding the entire multi-walled configuration is used to thermally insulate chamber 10 and at the same time to uniformly distribute the mechanical forces which act on inner layers 3, 6A, 6B of wall 12 of chamber 10.

Porous outer layer 9 made of $ZrO_2$ is oxygen-permeable, so that oxygen is able to reach ceramic layers 6A and 6B situated between outer layer 9 and oxygen ion conductor 3, and which also allows oxygen transport to cathode 4A and 4B of device 2 for enriching process space 11 with oxygen radicals.

Ceramic layer 6A and 6B, representing a middle layer of wall 12, is simultaneously used as an insulation layer into which a heater 8 is inserted. In the exemplary embodiment shown, heater 8, embedded in $Al_2O_3$ ceramic layer 6A and 6B, is designed as a meandering platinum element.

Figure 2:
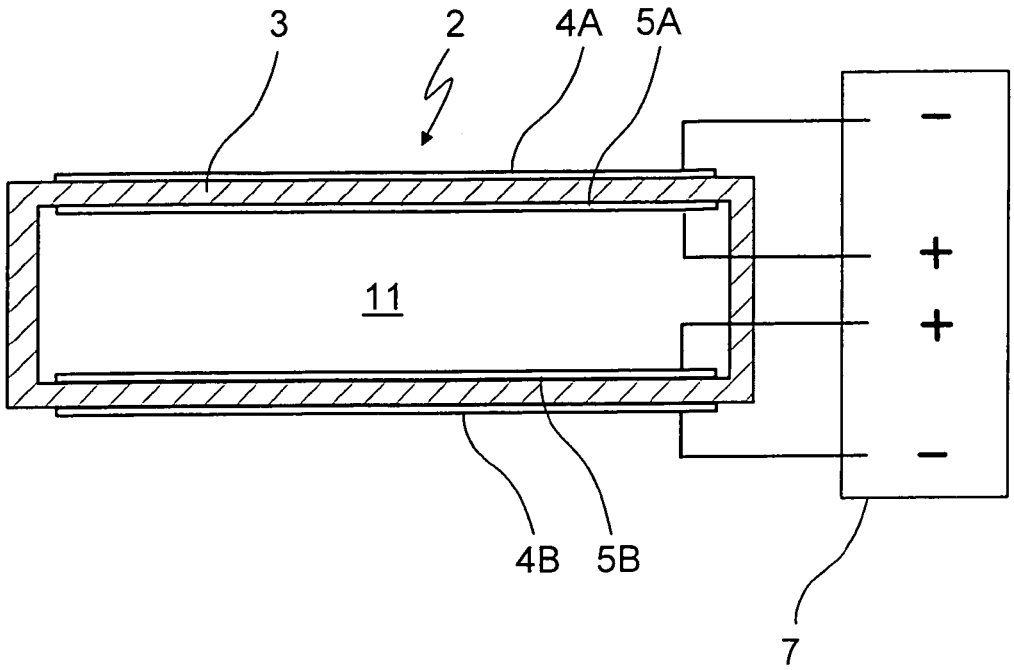
FIG. 2 shows a schematic representation of an electrode system of a device for enriching the process space with oxygen radicals.

Device 2 for enriching process space 11 of chamber 10 with oxygen ions, apparent in FIG. 1, is schematically shown in FIG. 2 as a stand-alone diagram to demonstrate the electrical connection of electrodes 4A, 4B, 5A, 5B, it being apparent that cathodes 4A and 4B, situated on the side of $ZrO_2$ oxygen ion conductor 3 facing away from process space 11, are connected to a negative pole and anodes 5A and 5B, directly delimiting process space 11, are connected to a positive pole of a power source 7. When the circuit is closed, oxygen radicals from oxygen ion conductor 3 are released at anode 4A and 4B.

It is understood that in addition to the ceramic materials used, other suitable materials may also be used for the oxygen transport and the release of oxygen radicals in the process space in further embodiments of the ignition system according to the present invention.

Figure 3:
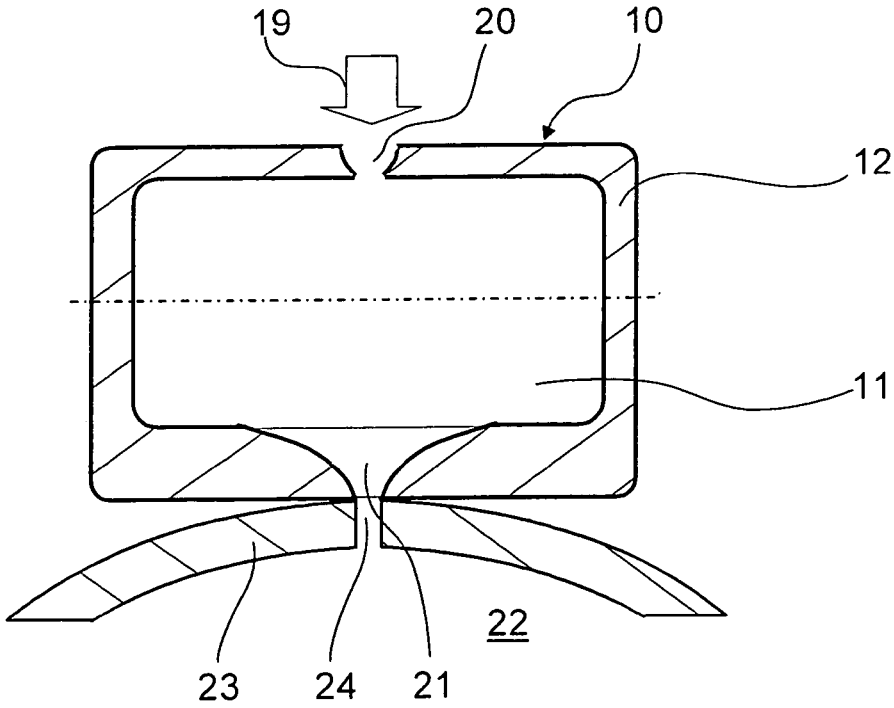
FIG. 3 shows a schematic cross section of the device shown in FIG. 1.

FIG. 3 shows in greatly simplified form a section along a horizontal middle plane through chamber 10 of FIG. 1; an inlet aperture 20 and an outlet aperture 21 for the fuel/air mixture are apparent in the multilayer wall 12 of chamber 10. Inlet aperture 20 is connected to an only figuratively shown injection device 19 of the conventional type, which may be designed as a blow nozzle, a piezoelectrically operated injector, or an electrokinetically controlled pump.

Outlet aperture 21 of chamber 10 opens to a main combustion chamber 22 in a cylinder block 23 of the internal combustion engine, a piston of the internal combustion engine enclosing main combustion chamber 22 being situated in cylinder block 23 in a manner known per se.

It is understood that sensors and control means, which are known per se, for controlling the entry of the fuel/air mixture into cylinder block 23 via an inlet aperture 24 of main combustion chamber 22 may be provided.

Figure 4A:
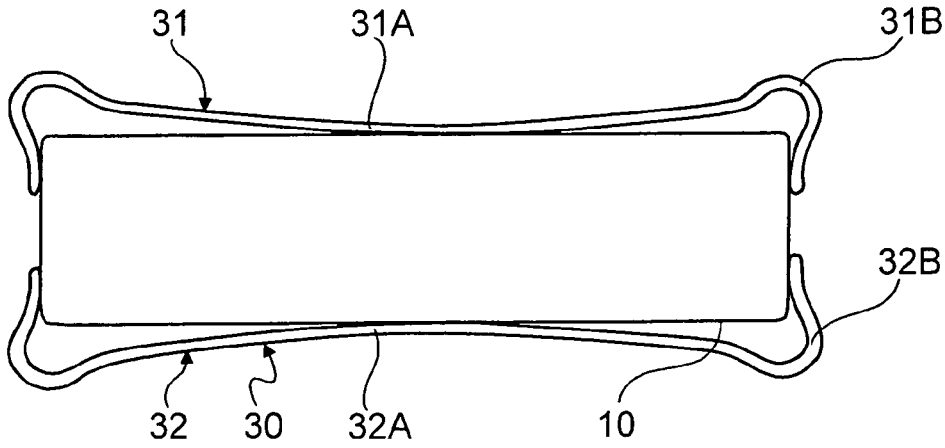
FIGS. 4*a* through 4*c* show a schematic representation of individual manufacturing steps for manufacturing the device shown in FIGS. 1 and 3.
Figure 4B:
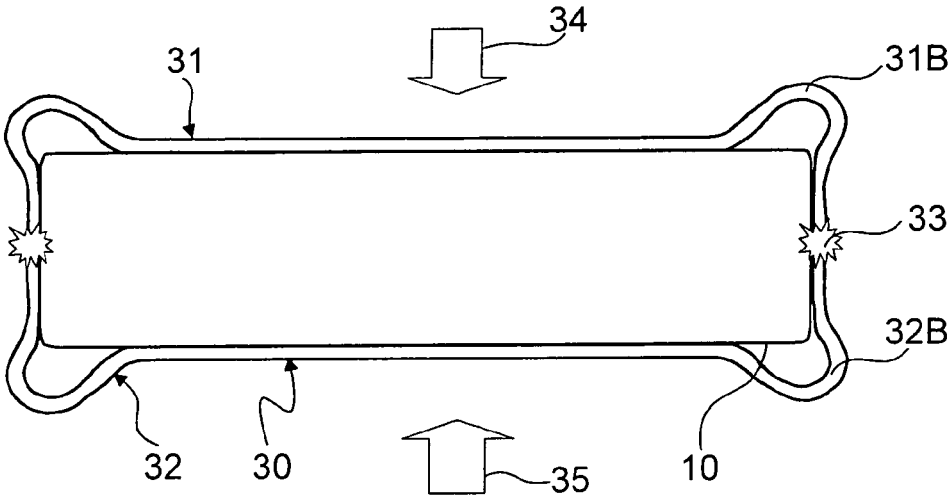
Figure 4C:
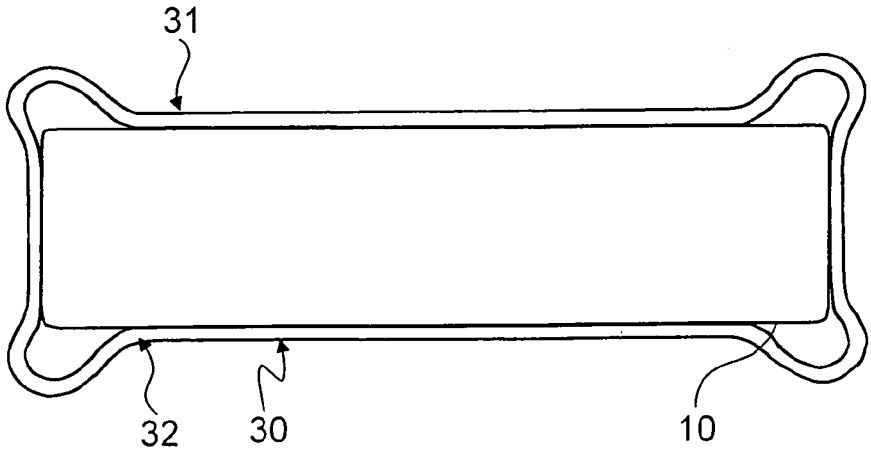

For improving the pressure stability and for better assembly of chamber 10 on cylinder block 23, chamber 10 is in the present case surrounded by a reinforcing device 30 which is shown in greater detail in FIGS. 4*a* through 4*c*.

FIGS. 4*a* through 4*c* show in detail the assembly steps for mounting reinforcement device 30 at the beginning of wall 12 of chamber 10.

As is apparent in FIG. 4*a*, reinforcement device 30 is formed in the embodiment shown using two essentially U-shaped clamp elements 31, 32 made of spring steel. The U legs as well as the middle area of the respective clamp elements 31, 32 are bent in such a way that initially only a middle area 31A and 32A of clamp elements 31 and 32 comes in contact with opposite outsides of chamber 10, while the respective U legs and sides 31B and 32B of clamp elements 31, 32 are distanced to one another.

As is apparent in detail in FIG. 4*b*, both clamp elements 31, 32 are acted upon by outside force, indicated by force direction arrows 34, 35, in such a way, e.g., using a press, that the ends of U legs 31B, 32B come in contact so that they may be bonded to one another via a weld seam 33, e.g., using laser welding.

The frame-like or housing-like reinforcement device 30, apparent in FIG. 4*c*, is thus formed by clamp elements 31, 32 which are under tension, the reinforcement device, due to its pre-stressing, counteracting forces which act in chamber 10 toward the outside.

Figure 5A:
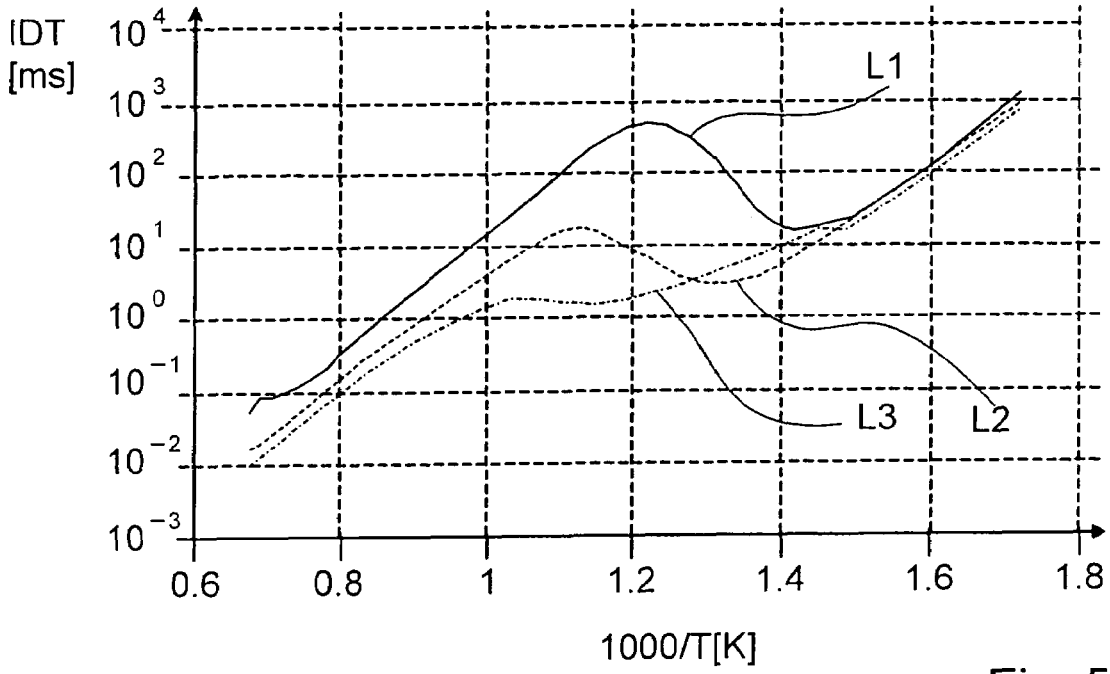
FIG. 5*a* shows an exemplary diagram which shows the ignition delay time as a function of the temperature at different pressures.
Figure 5B:
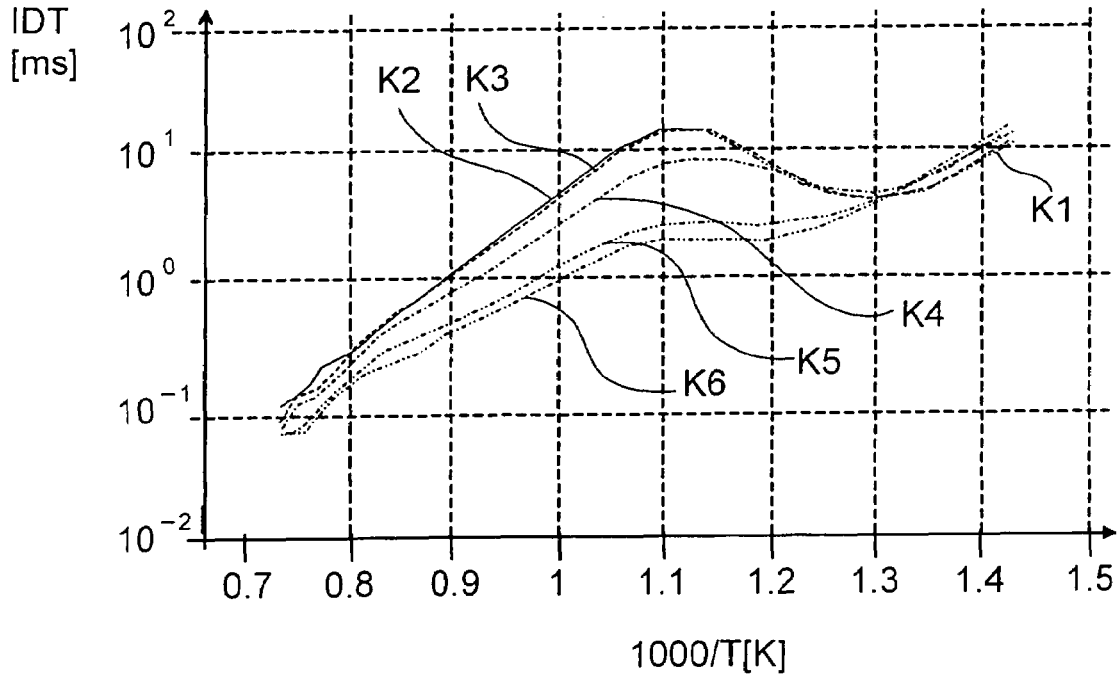
FIG. 5*b* shows an exemplary diagram which shows the ignition delay time in an ignition system according to the present invention as a function of the temperature at different oxygen radical concentrations.

FIGS. 5*a* and 5*b* show diagrams which make apparent how the ignition of different mixes of fuel/air mixtures may be influenced and controlled by releasing oxygen radicals.

FIG. 5*a* shows an exemplary diagram which represents a calculated ignition delay time IDT for an n-heptane-air mixture having a volumetric efficiency of $\lambda=2$ and $\phi=0.5$ as a function of temperature T plotted as 1000/T [K] for different pressures.

A first curve L1 for a pressure of 3.2 bar, a second curve L2 for a pressure of 13.5 bar, and a third curve L3 for a pressure of 42 bar can be seen. For example, an ignition delay time IDT of approximately 15 ms thus results for a lean fuel/air mixture having a volumetric efficiency of $\lambda=2$ at a pressure of 42 bar and a temperature of approximately 650° C. As can be seen from L1, L2, and L3, the ignition delay time may vary, however, between 2 ms and approximately 5 ms.

FIG. 5*b* shows a diagram of a calculated ignition delay time IDT for an n-heptane-air mixture having a volumetric efficiency of $\lambda=2$ at a pressure of 13.5 bar and $\phi=0.5$ as a function of temperature T plotted as 1000/T [K] for different oxygen radical concentrations.

Six different curves K1, K2, K3, K4, K5, and K6 can be seen which have been calculated at different oxygen radical concentrations. Curve K1 represents an oxygen radical mass proportion of 0.0000, curve K2 represents an oxygen radical mass proportion of 0.00001, curve K3 represents an oxygen radical mass proportion of 0.0001, curve K4 represents an oxygen radical mass proportion of 0.001, curve K5 represents an oxygen radical mass portion of 0.005, and curve K6 represents an oxygen radical mass proportion of 0.01.

As can be seen, very short time spans for ignition delay time IDT of an order of magnitude of approximately 2 ms result in curve K6 characterized by a high proportion of 0.01 of oxygen radicals. The lower the oxygen radical concentration in the process space, the more the ignition delay time increases until a significant difference is no longer discernible between a mass proportion of 0.0001 and 0.0000.

The curves in FIG. 5*b* clearly demonstrate the strong influence of the oxygen radical mass proportion on the ignition point. Even if a small amount of oxygen ions is added to the fuel/air mixture, the self-ignition delay time is clearly reduced. For example, at the same pressure and temperature, the self ignition delay time is reduced to only 2 ms with a mass proportion of 0.01 of oxygen radicals in the fuel/air mixture.

By suitably designing electrodes 4A, 4B, 5A, 5B and dimensioning the volume in process space 11 in chamber 10, the time for enriching process space 11 with oxygen radicals may additionally be kept very short. In the shown embodiment, an oxygen radical mass proportion of 0.01 is already achievable in approximately 5 ms for a small chamber volume and a height of process space 11 of approximately 2 mm, for example.

Self-ignition and the ignition point of the fuel/air mixture may be optimized via targeted control of the current through electrodes 4A, 4B, 5A, 5B of the device according to the present invention.

What is claimed is:

1. An ignition system of an internal combustion engine comprising:

at least one device for igniting a jet of a fuel/air mixture having a chamber enclosing a process space in which the ignition of the fuel/air mixture takes place, the chamber having a device for enriching the process space with oxygen radicals, wherein the device for enriching the process space with oxygen radicals includes at least one oxygen ion conductor.

2. The ignition system according to claim 1, wherein the at least one oxygen ion conductor is situated as a solid electrolyte between two electrodes in the chamber.

3. The ignition system according to claim 2, wherein a first of the electrodes facing the process space of the chamber is an anode and a second of the electrodes is a cathode.

4. The ignition system according to claim 2, wherein the oxygen ion conductor forms an innermost layer of a multilayer wall of the chamber.

5. The ignition system according to claim 2, wherein the chamber includes an oxygen-permeable layer situated on a side of the oxygen ion conductor and the electrodes facing away from the process space, the oxygen-permeable layer being composed of a porous ceramic material.

6. The ignition system according to claim 5, further comprising a heater embedded in the oxygen-permeable layer.

7. The ignition system according to claim 2, wherein the oxygen ion conductor is composed of yttrium-doped zirconium dioxide.

8. The ignition system according to claim 2, wherein the electrodes are composed of platinum.

9. The ignition system according to claim 1, wherein a wall of the chamber has an outer layer which distributes forces from the process space acting on the wall.

10. The ignition system according to claim 1, further comprising a reinforcement device surrounding the chamber.

11. The ignition system according to claim 10, wherein the reinforcement device is a frame-like element which is made of spring steel.

12. The ignition system according to claim 1, wherein the ignition system is for an internal combustion engine of a motor vehicle.

13. The ignition system according to claim 1, wherein the chamber has a volume of 1 $cm^3$ or less.

* * * * *